US006357736B1

(12) United States Patent
Kubota et al.

(10) Patent No.: US 6,357,736 B1
(45) **Date of Patent: *Mar. 19, 2002**

(54) SHEET POST-HANDLING DEVICE

(75) Inventors: Kazuyuki Kubota; Hideki Mimura, both of Yamanashi-ken (JP)

(73) Assignee: Nisca Corporation, Yamanashi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/084,862

(22) Filed: May 26, 1998

Related U.S. Application Data

(63) Continuation-in-part of application No. 09/022,625, filed on Feb. 12, 1998, now Pat. No. 5,997,239.

(30) Foreign Application Priority Data

May 26, 1997 (JP) ..... 9-153030

(51) Int. Cl.[7] ..... B65H 33/04

(52) U.S. Cl. ..... 270/58.08; 414/790.2; 414/789.9

(58) Field of Search ..... 414/790.2, 790.1, 414/789.9; 270/58.08

(56) References Cited

U.S. PATENT DOCUMENTS 5,465,947 A * 11/1995 Okumura et al. ..... 270/58.18
5,732,940 A * 3/1998 Kobayashi et al. ..... 270/58.01
5,957,652 A * 9/1999 Mimura et al. ..... 270/58.01
5,997,239 A * 12/1999 Mimura et al. ..... 414/789.9

FOREIGN PATENT DOCUMENTS

JP 6-9142 A 1/1994

* cited by examiner

*Primary Examiner*—Christopher P. Ellis
*Assistant Examiner*—Richard Ridley
(74) *Attorney, Agent, or Firm*—Pitney, Hardin, Kipp & Szuch LLP

(57) ABSTRACT

A sheet post-handling device for aligning one or more sheets fed from an image forming apparatus such as a copying machine to a first tray in a sheet introducing direction, and transferring the sheets aligned from the first tray to a second tray in a sheet transferring direction perpendicular to the sheet introducing direction to store the sheets on the second tray. The sheets aligned into a sheaf of sheets are held by a holding member when being transferred from the first tray to the second tray, and delivered to a gripping means movable over the second tray so as to be softly landed on the second tray. Thus, the sheaf of sheets can be stably transferred from the first tray to the second tray while being reliably gripped by the gripping means, consequently being securely placed on the second tray without suffering damage. The sheets are stapled during being transferred from the first tray to the second tray.

12 Claims, 14 Drawing Sheets

SHEET POST-HANDLING DEVICE

RELATED APPLICATION

This is a Continuation-In-Part of application Ser. No. 09/022,625 filed Feb. 12, 1998 and issued as U.S. Pat. No. 5,997,239 on Dec. 7, 1999.

BACKGROUND OF THE INVENTION

1. Field of the Invention

This invention relates to a sheet post-handling device for taking in and storing sheets fed from an image forming apparatus such as a copying machine, and more particularly to a device for stably stacking sheets which are aligned and bound on a tray in a sheet storage section.

2. Description of the Prior Art

Sheet handling devices for automatically sorting, aligning, binding and storing recorded sheets continuously fed from an image forming apparatus such as a copying machine, printer, and facsimile have been used.

A conventional sheet post-handling device of this type has been known, in which sheets continuously fed from the image forming apparatus are sorted and distributed into bin trays to form sheaves of sheets in the bin trays, and then, the sheaves of sheets are bound with staples as occasion calls. One example of the conventional sheet post-handling devices is disclosed in Japanese Patent Application Public Disclosure No. 6-9142(A). The conventional device comprises a sheet processing section for binding sheets continuously fed from the image forming apparatus into a sheaf of sheets, and a sheet storing section for stacking the sheaf of bound sheets, which sections are placed side by side.

In the aforenoted conventional sheet post-handling device, the sheets continuously fed from the image forming apparatus are sent one by one into a first tray in a sheet processing section, aligned and bound into a sheaf of sheets and then, transferred to a second tray in a sheet storing section by use of sheet transferring means. The sheaves of sheets bound stored in the sheet storing section in order can be freely taken out. This sheet post-handling device has no need for multistage bin trays and a system for controlling the bin trays, and thus, can be made relatively simple in structure and small in size.

In the aforementioned conventional post-handling device employing stationary rollers for transferring the sheaf of sheets from the first tray to the second tray, as a matter of course, the second tray is placed lower in level than the first tray in order to transfer the sheaf of sheets from the first tray to the second tray without a hitch. When the sheaf of bound sheets is transferred from the first tray to the second tray by use of the stationary transferring rollers disposed above the second tray, the sheaf of sheets released from the stationary rollers falls to the second tray. As a result, the sheaves of sheets successively sent into the sheet storing section and falling to the second tray are accumulated in disarray on the second tray. Especially, the disarray of the sheaves of bound sheets on the second tray becomes conspicuous with elevating the operation speed at which the sheets are sent. Ultimately, the conventional device disadvantageously calls for the onerous work of tidying up the sheaves of sheets stacked in disarray on the second tray afterward, and further entails the risk of damaging the sheaf of bound sheets.

OBJECT OF THE INVENTION

An object of the present invention is to provide a sheet post-handling device capable of efficiently aligning and binding sheets continuously fed from an image forming apparatus such as a copying machine into one or more sheaves of bound sheets, reliably transferring the sheaves of sheets to a sheet storing section, and accumulating and storing the sheaves of sheets in order in the sheet storing section.

Another object of the present invention is to provide a sheet post-handling device capable of stably transferring and storing the sheaf of sheets aligned and bound without imposing a burden on the sheets.

Still another object of the present invention is to provide a sheet post-handling device easy to handle and diminished in size, which is capable of performing after-processing for handling the sheets at a high speed without retarding the image forming apparatus operable at a high speed.

SUMMARY OF THE INVENTION

To attain the objects described above according to the present invention, there is provided a sheet post-handling device comprising a first tray for stacking one or more sheets thereon, means for transferring the aforesaid one or more sheets stacked on the first tray while holding the sheets, a second tray for stacking the sheets sent from the first tray by the transferring means, means for gripping the sheets arriving at the second tray, means for moving the gripping means along the surface of the second tray, and means for tilting vertically the gripping means located at a sheet releasing position in the second tray.

The sheets fed onto the first tray are aligned by sheet aligning means and bound with a staple or staples into a sheaf of sheets while being transferred from the first tray to the second tray.

The sheaf of sheets thus aligned and bound is sent toward the second tray by the transferring means and passed to the gripping means at the second tray.

When the sheaf of sheets gripped by the gripping means arrives at a prescribed position just over the second tray while the gripping means reaches the sheet releasing position, the gripping means is tilted downward to bring the gripped sheets close to the second tray, and then, releases the gripped sheets. Thus, the sheaf of sheets can be softly landed on the second tray.

When a plurality of sheaves of sheets are consecutively sent to and accumulated on the second tray, the second tray is moved downward in accordance with the thickness of the sheaves of sheets stacked thereon.

When putting the sheaves of bound sheets on the second tray, it is desirable to displace alternately the sheaves of sheets slightly in direction in which the sheets are transferred, so as not to place the stapled portions of the sheets with staples on top of another. As a result, the bulk of the sheaves of sheets accumulated on the second tray can be reduced.

Other objects and features of the present invention will be hereinafter explained in detail with reference to the accompanying drawings.

DESCRIPTION OF THE PREFERRED EMBODIMENTS

Figure 1:
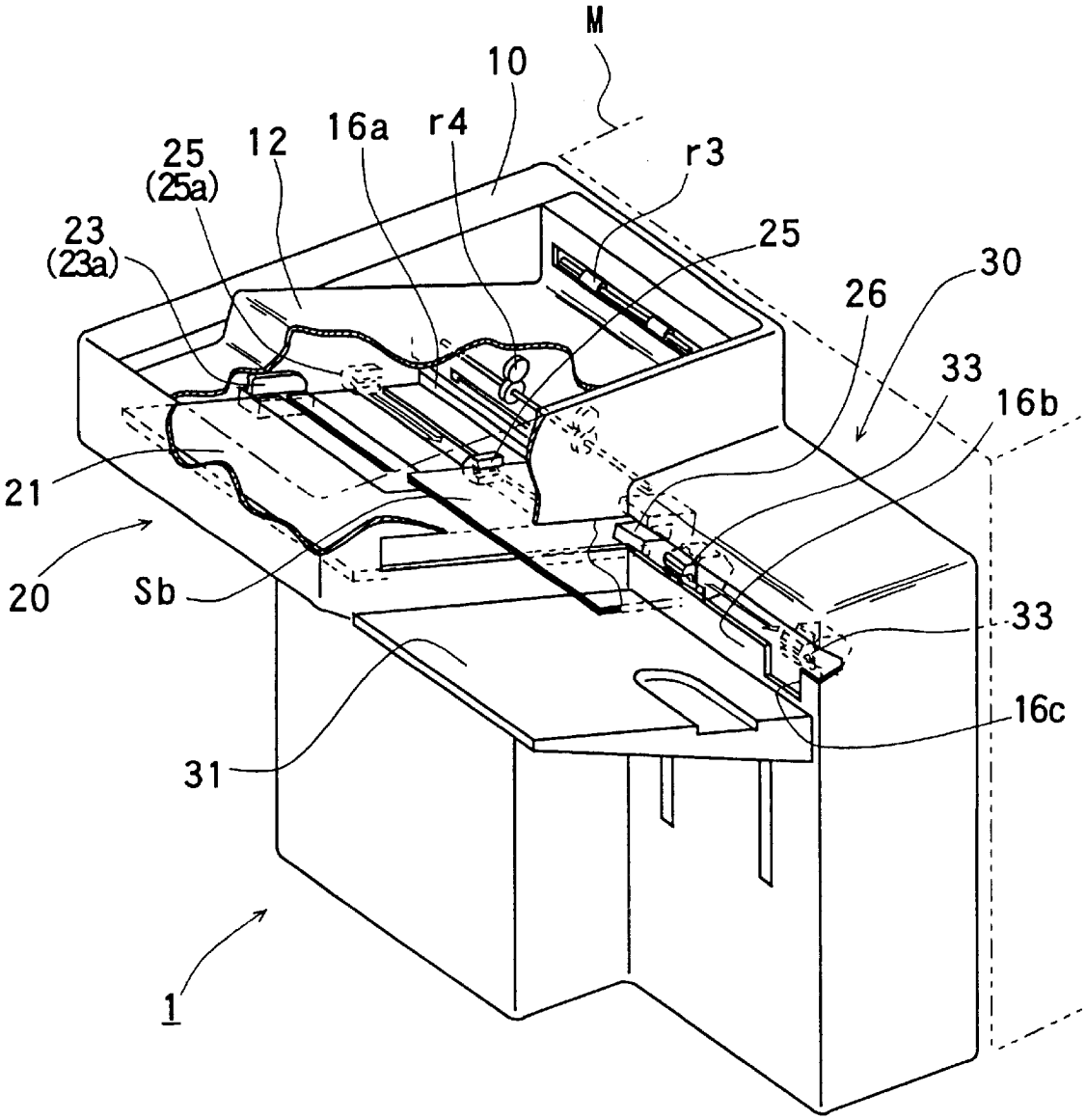
FIG. 1 is a partially cutaway perspective view showing one embodiment of a sheet post-handling device according to this invention.
Figure 2:
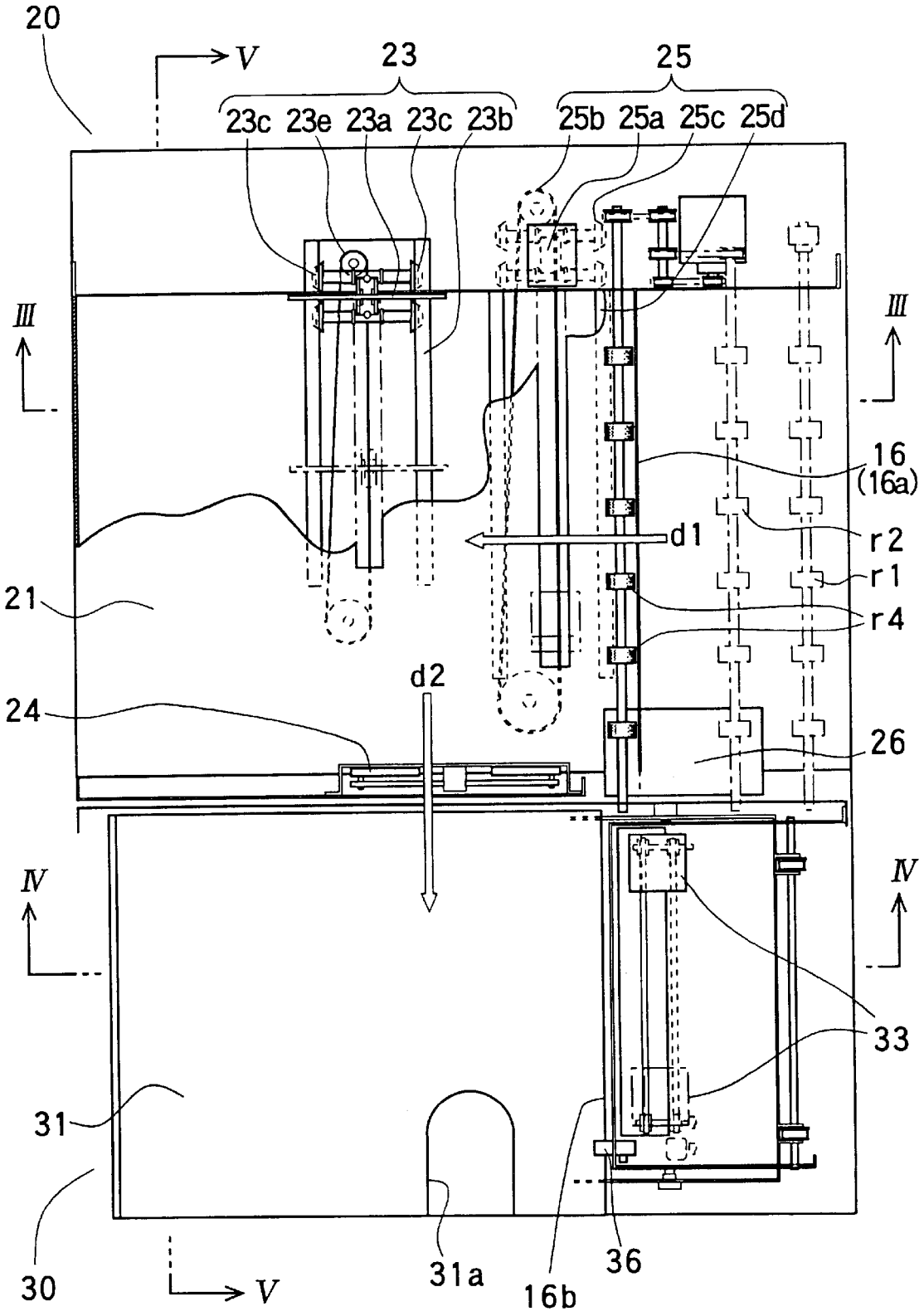
FIG. 2 is a schematic plan section showing the device of FIG. 1.
Figure 3:
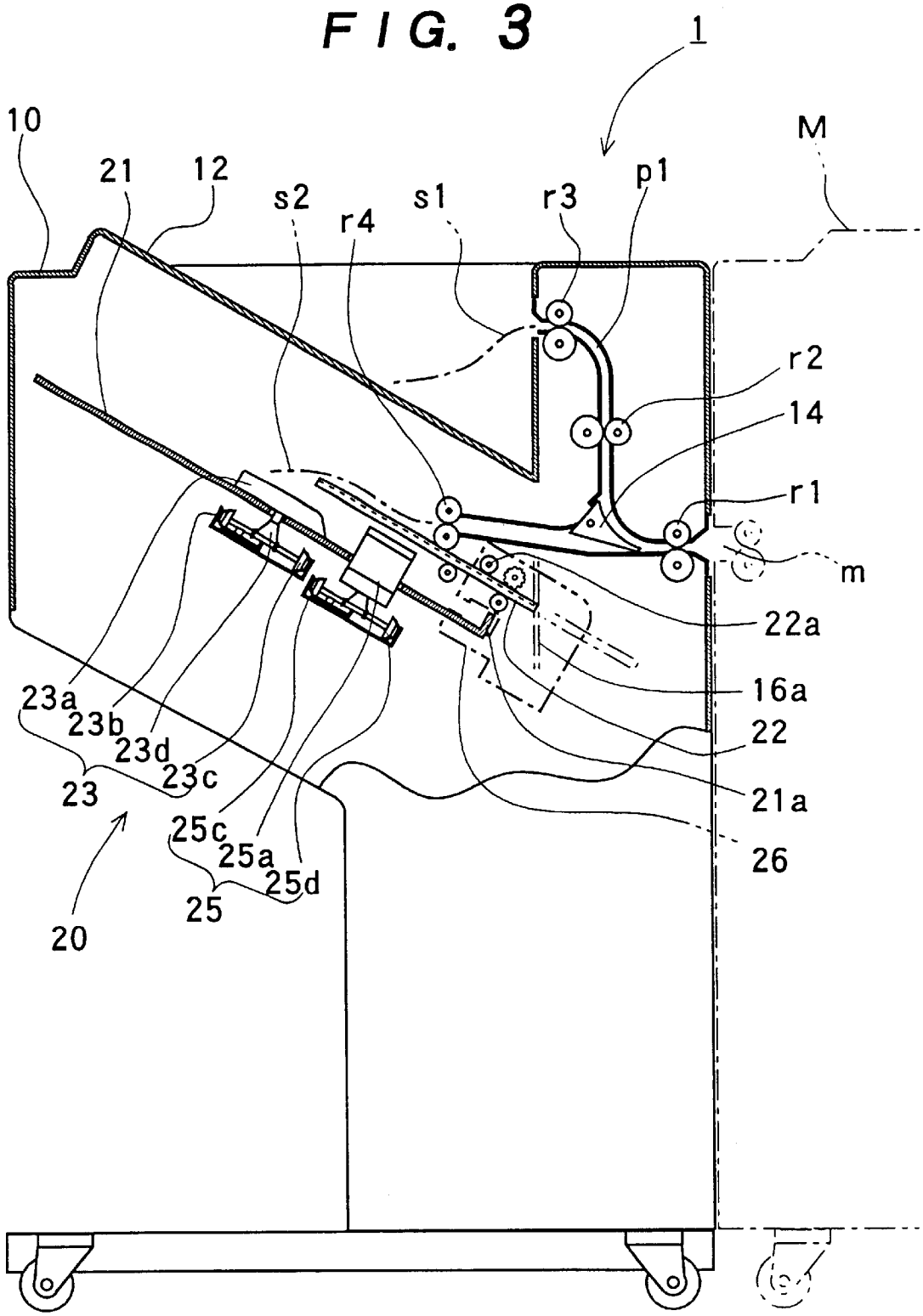
FIG. 3 is a schematic front section taken along the line III—III in FIG. 2.

This invention relates to a sheet post-handling device for automatically aligning, stapling and storing sheets successively fed from an image forming apparatus such as a copying machine with high efficiency. One embodiment of the sheet handling device according to this invention will be described with reference to the accompanying drawings.

As illustrated, the sheet post-handling device 1 of this invention is united with the image forming apparatus M in use in such a state that a sheet inlet port 10*a* formed in a housing 10 is joined to a sheet outlet port m of the image forming apparatus M. In addition to the copying machine touched upon above, a printer and facsimile are typical of the image forming apparatus, but the type of the apparatus to which this invention is applied is not specifically limited thereto. This invention can be applied to various sorts of sheet handling devices including a printing press, bookbinding device and so on.

The sheet post-handling device 1 of this embodiment according to the invention comprises a sheet processing section 20 in which one or more sheets s1,s2, . . . fed from the image forming apparatus M are accommodated, aligned and bound into a sheaf of sheets Sb, and a sheet storing section 30 for storing one or more sheaves of sheets obtained in the sheet processing section 20. The sheet processing section 20 is placed beside the sheet outlet port m of the image forming apparatus M relative to a sheet introducing direction (sheet discharging direction) d1. The sheet storing section 30 is juxtaposed with the sheet processing section 20 relative to a sheet transferring direction d2 perpendicular to the sheet introducing direction d1.

There is formed an inclined top tray 12 on the upper surface of the housing 10 of the sheet processing section 20. When there is no call for subjecting the sheet fed from the image forming apparatus to any post-processing, the sheet s1 is sent from the sheet inlet port 10*a* to the top tray 12 through a sheet passage p1.

In the case of aligning and binding sheets continuously fed from the image forming apparatus M, the sheet s2 is sent to the sheet processing section 20 through a sheet passage p2. At a diverging point of the sheet passages p1 and p2, a switching flap 14 is disposed so as to send the sheet fed from the image forming apparatus M selectively to the top tray 12 via the sheet passage p1 or the sheet processing section 20 via the sheet passage p2 in accordance with the operation mode prescribed at the image forming apparatus. Reference symbols r1 to r4 denote feed rollers mounted on the sheet passage extending from the sheet inlet port 10.

The sheet processing section 20 includes a first tray 21 for stacking sheets fed from the image forming apparatus M thereon, a waiting tray 22 movable to and fro between the sheet passage p2 and the first tray 21 in the sheet introducing direction d1, means 23 for aligning the sheets stacked on the first tray 21 in the sheet transferring direction d2, an aligning reference shutter 24 disposed movably vertically at the front end of the first tray 21 relative to the sheet transferring direction d2, means 25 for transferring the sheets aligned on the first tray 21 along the surface of the first tray 21, and means 26 for stapling the sheets on the first tray 21.

The first tray 21 is located beneath an exit port of the sheet passage p2 and inclined upward in the sheet introducing direction d1. The first tray 21 has a sheet transferring reference surface 21*a* which stands upright relative to the surface of the stacking tray at the lowermost rear end of the stacking tray. Thus, a sheet fed from the image forming apparatus onto the first tray spontaneously slides down the inclined surface of the first tray in the direction opposite to the sheet introducing direction until colliding with the sheet transferring reference surface 21*a*, consequently to align the sheets with the sheet transferring reference surface.

Figure 5:
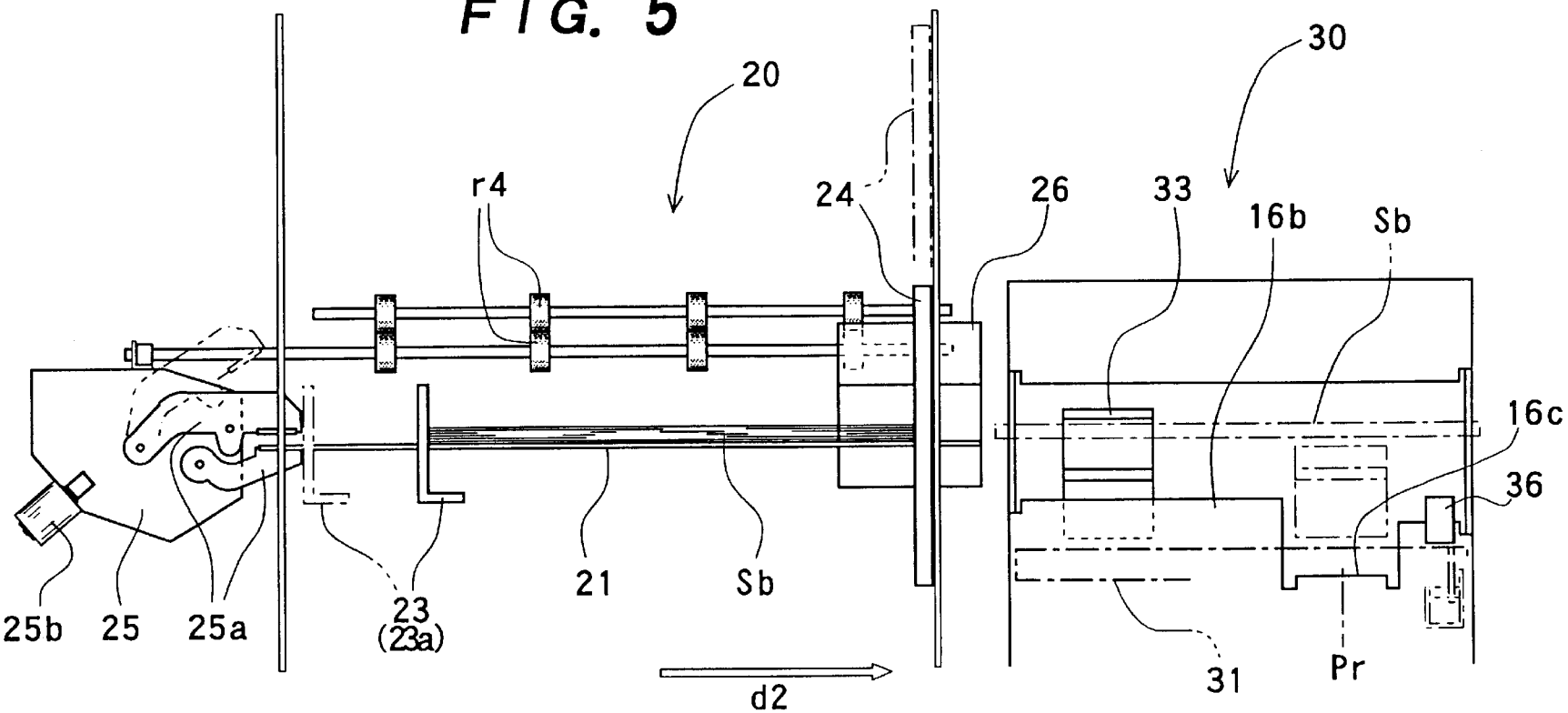
FIG. 5 is a schematic front section taken along the line V—V in FIG. 2.
Figure 6:
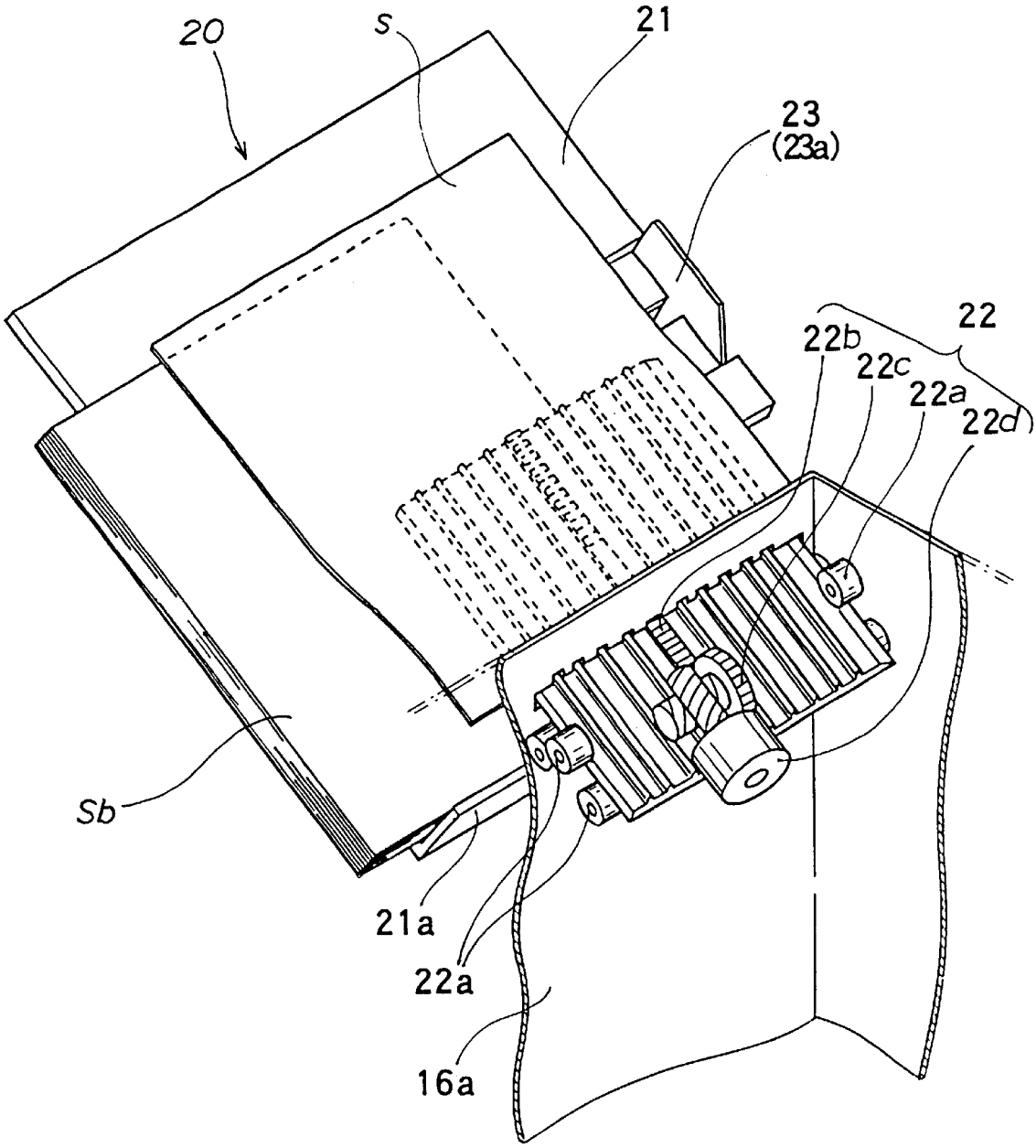
FIG. 6 is a perspective view showing in part a waiting tray in the device according to this invention.

The waiting tray 22 for temporarily holding a sheet for a succeeding sheaf of sheets, which is introduced from the image forming apparatus M into the sheet post-handling device, until the sheaf of sheets being processed on the first tray 21 is completely sent out from the first tray 21. As shown in FIG. 5 and FIG. 6, the waiting tray is supported movably by holding rollers 22*a* so as to move in and out with respect to the sheet transferring reference surface 21*a* in the sheet introducing direction d1 in parallel to the inclined first tray 21. The waiting tray 22 is held on each side thereof by a three-point supporting mechanism comprising two lower rollers being in contact with the lower surface of the waiting tray and an upper roller being in contact with the upper surface of the waiting tray at the middle portion between the lower rollers. With this supporting mechanism, the waiting tray 22 is movable to and fro relative to the first tray 21 at a fixed angle.

The waiting tray 22 is moved to and fro by use of driving means including a rack 22*b* formed on the upper side of the waiting tray, a pinion 22*c* rotatably meshed with the rack 22*b*, and a motor 22*d* for rotating the pinion 22*c*, but this mechanism should not be understood as being limited thereto.

The aligning means 23 comprises an aligning member 23*a* which stands upright relative to the first tray 21 and is movable to and fro in the sheet transferring direction p2 along the upper surface of the first tray 21, a pair of guide rails 23*b* arranged under the stacking tray of the first tray 21 and extending in the sheet transferring direction p2, rollers 23*c* movable along the guide rails 23*b*, a member 23*d* for connecting the rollers 23*c* with the aligning member 23*a*, and means 23*e* for driving the rollers 23*c* to move the aligning member to and fro along the guide rails 23*b*. The first tray 21 has a guide slot 21*b* extending in the sheet transferring direction d1 so as to guide the aforenoted connecting member 23*d* in one direction. By operating the driving means 23*e* which generally comprises an endless belt and pulleys, the rollers 23*c* are movable along the guide rails 23*b* to move the aligning member 23*a* to and fro in the sheet transferring direction d2.

The aligning reference shutter 24 disposed at the front end portion of the first tray relative to the sheet transferring direction d2 is movable vertically to selectively block the passage of the sheets Sb to be sent out from the first tray.

For aligning the sheets stacked on the first tray 21 in the sheet transferring direction, the aligning reference shutter 24 is situated at its lower position (closed state) to block the advance of the sheets, and the aligning member 23*a* is moved in the sheet transferring direction d2 to push the sheets on the first tray against the aligning reference shutter 24. Consequently, the front and rear edges of the sheets on the first tray 21 are trued up in the sheet transferring direction.

The sheet transferring means 25 comprises a holding member 25*a* for grasping the rear part of the sheaf of sheets relative to the sheet transferring direction d2, driving means 25*b* for rendering the sheet grasping of the holding member 25*a*, a pair of guide rails 25*c* disposed under the upper surface of the first tray 21 and extending in the sheet transferring direction d2, rollers 25*d* movable along the guide rails 25*c*, and another driving means 25*e* for moving the rollers 25*d* to and fro along the guide rails 25*c* in the sheet transferring direction d2.

The holding member 25*a* has upper and lower claws between which the sheets Sb stacked on the first tray 21 are gripped, so that the sheets Sb can be stably transferred to the sheet storing section 30 in the sheet transferring direction d2.

The stapling means 26 in this embodiment may be a common electrically-powered stapler which is generally incorporated in a sheet handling device of this sort, but not specifically peculiar to the invention.

The stapling means 26 is mounted at the front end of the sheet transferring reference surface 21*a* of the first tray 21 relative to the sheet transferring direction d2. When the sheets Sb are transferred along the sheet transferring reference surface 21*a* by the transferring means 25, one or more staples are arbitrarily thrust into the margin part of the sheaf of sheets Sb, which is in contact with the sheet transferring reference surface 21*a*.

The sheet storing section 30 comprises a second tray 31 formed of a vertically movable stacking tray for stacking the sheaf of sheets Sb sent from the sheet processing section 20, lifting means 32 for vertically moving the second tray 31, means 33 for gripping the sheets Sb sent from the sheet processing section 20 by the transferring means 25, means 34 for moving the gripping means 33 in the sheet transferring direction d2, tilting means 35 for vertically rocking the gripping means 33, and means 36 for detecting the height of the sheets accumulated on the second tray 31.

The second tray 31 in this embodiment is inclined upward in the sheet introducing direction d1, similarly to the first tray 21, so that the bound sheets landed on the second tray spontaneously slide down the inclined second tray in the direction opposite to the sheet introducing direction d1 until coming into collision with a vertical wall 16*a* (sheet storage reference surface) of a device frame 16. Thus, the sheaves of sheets sent to the second tray are always aligned with the sheet storage reference surface 16*a*. The second tray 31 has a concave 31*a* for easily taking off the sheets Sb accumulated on the second tray.

The sheet storage reference surface 16*a* in the sheet storing section 30 is located forward of the sheet transferring reference surface 21*a* of the first tray 21 relative to the sheet introducing direction d1. Consequently, movable elements including the gripping means 33 and the moving means 34 are covered with the device frame 16 having the sheet storage reference surface 16*a* so as not to expose an operator to danger.

The lifting means 32 for vertically moving the second tray 31 comprises, as illustrated specifically in FIG. 4 and FIG. 7, driving means 32*a* including a motor, a driving pulley 32*b* attached to the rotary shaft of the motor, a tail pulley 32*c* disposed below the driving pulley 32*b*, a belt 32*d* suspended between the pulleys 32*b* and 32*c*, a lifting frame 32*e* carried by the belt 32*d* to hold the second tray 31, guide rollers 32*f* mounted on the lifting frame 32*c* in vertically spaced relationship from each other, and guide slots 32*g* formed on both side walls of the device frame 16 for guiding the guide rollers 32*f*.

The second tray 31 is held in its inclined state by the lifting frame 32*e* as noted above and movable vertically in conjunction with the guide rollers 32*f* slidably guided by the guide slots 32*g* extending vertically. Thus, the second tray 31 kept in its inclined state is moved in the vertical direction as indicated by the arrow in FIG. 4 by operating the driving means 32*a*.

Figure 8A:
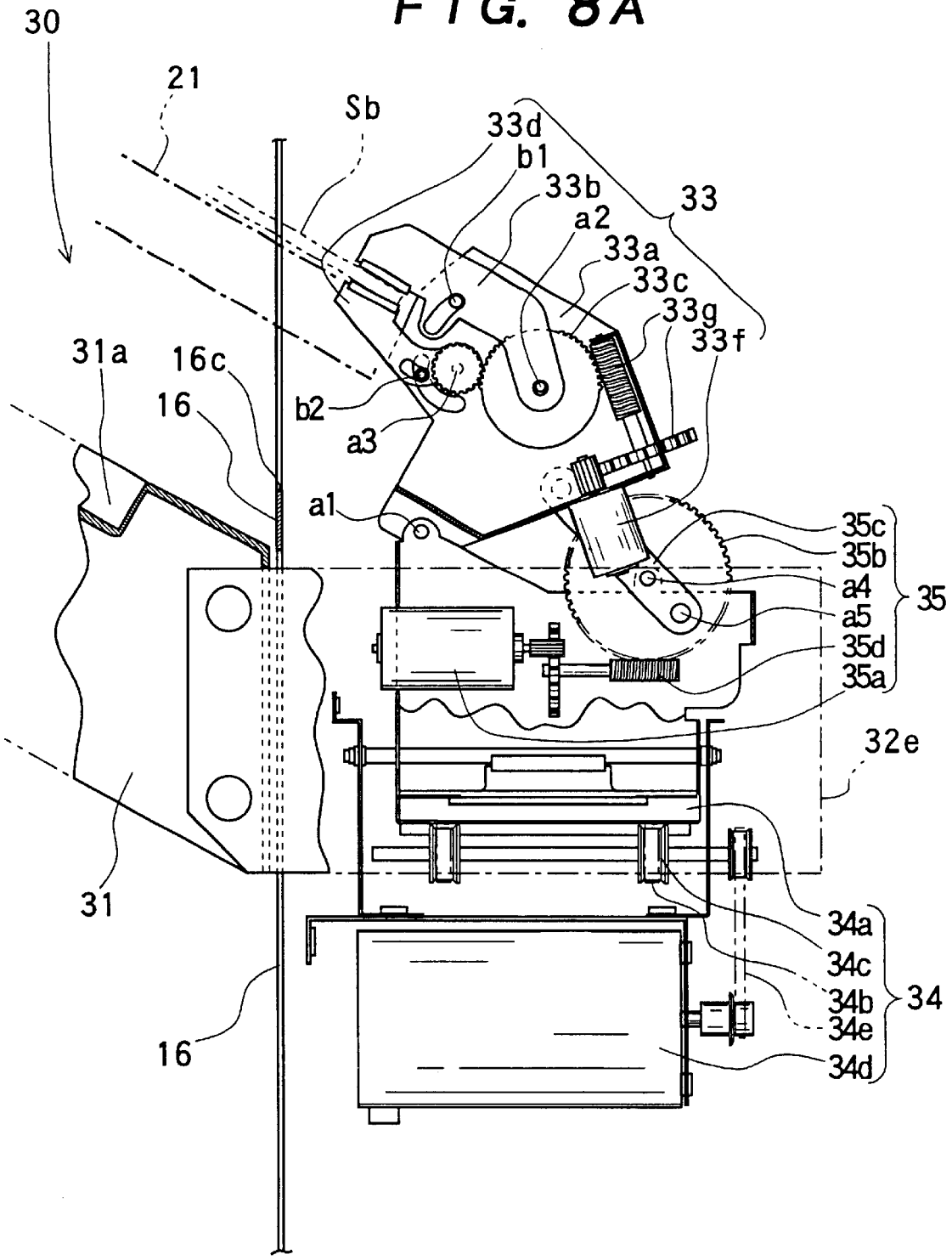
FIG. 8A and FIG. 8B are front sectional views showing the mechanism for operating the sheet storing section.
Figure 8B:
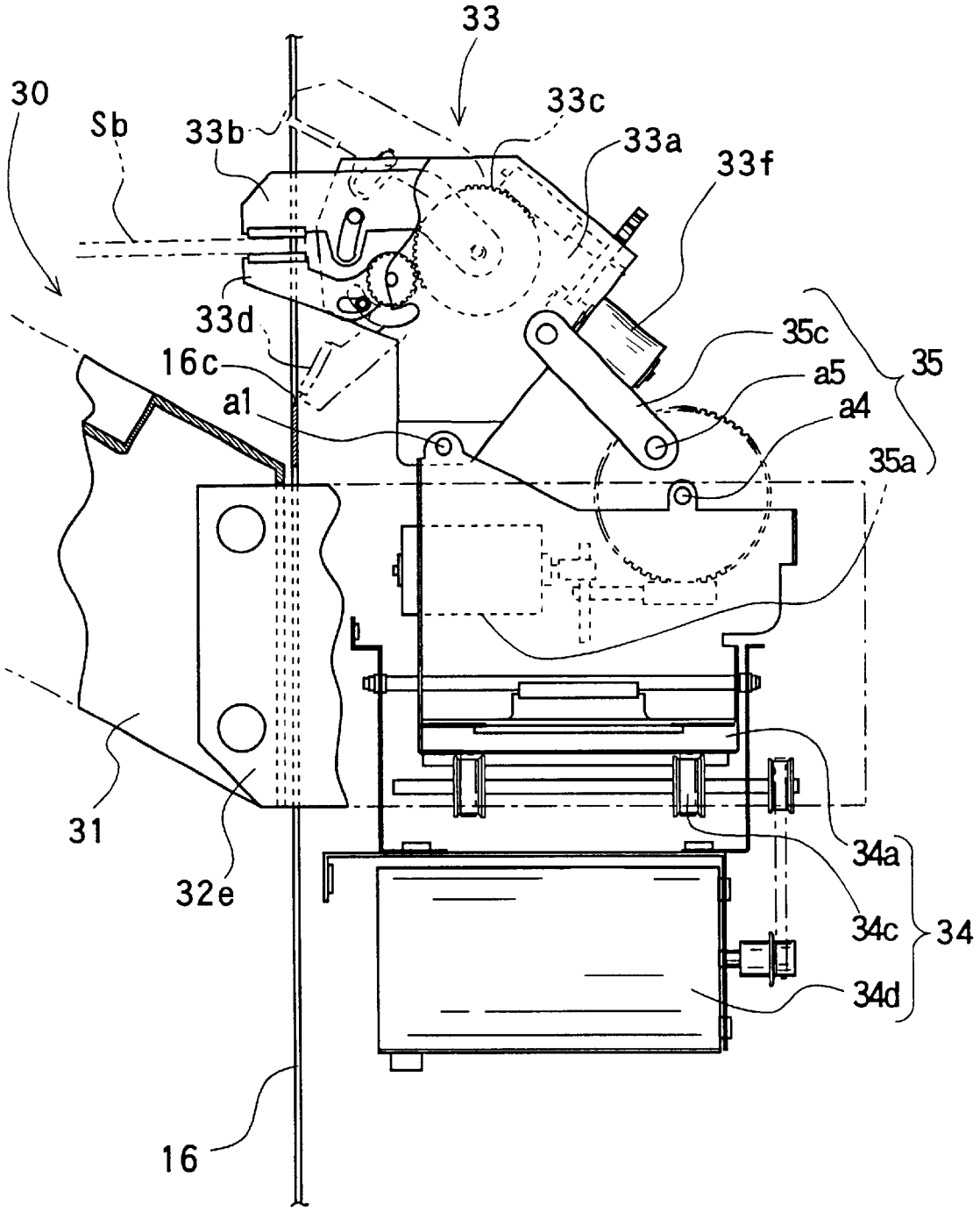

The gripping means 33 for gripping the sheets Sb sent to the sheet storing section 30 comprises, as shown specifically in FIG. 8A and FIG. 8B, a frame member 33*a* rotatably supported at a shaft a1 retained on the device frame, an upper jaw 33*b* rotatably supported by the frame member 33*a* through a shaft a2, a gear 33*c* attached to the shaft a2 of the upper jaw 33*b* so as to rotate in concert with the upper jaw 33*b*, a lower jaw 33*d* rotatably supported by the frame member 33*a* through a shaft a3, a gear 33*e* attached to the shaft a3 of the lower jaw 33*d* so as to rotate in concert with the lower jaw 33*d* and meshed with the gear 33*c*, a motor 33*f* fixed on the frame member 33*a*, and means 33*g* for transmitting the rotation of the motor 33*f* to the gear 33*c*.

The upper jaw 33*b* and lower jaw 33*d* are respectively restricted in their rotation by restricting pins b1 and b2 slidably fitted into arc-shaped slots formed in the both side walls of the frame member 33*a*.

By operating the motor 33*f*, the gear 33*c* for the upper jaw 33*b* is rotated through the transmitting means 33*g* to rotate the upper jaw 33*b*, and simultaneously, the lower jaw 33*d* is rotated through the gears 33*c* and 33*e* in the direction opposite to that in which the upper jaw rotates. Thus, the upper and lower jaws 33*b* and 33*d* perform opening and closing operations for gripping or releasing the sheets.

The gear 33*c* for the upper jaw 33*b* may be made larger in pitch circle than the gear 33*e* for the lower jaw 33*d*, so as to open the lower jaw 33*d* more widely compared with the upper jaw 33*b* as shown in FIG. 8B. Consequently, when the sheaf of sheets gripped by the jaws is released just over the second tray, the lower jaw 33*d* sufficiently opens downward so as not to obstruct the sheets falling to the second tray 31. As one example, the upper jaw 33*b* is rotatable 30 degrees from its horizontal position (indicated by the solid line in FIG. 8B) to its upper open position (indicated by the chain line), and the lower jaw 33*d* is rotatable 90 degrees from its horizontal position to its lower open position. In this case, the number of teeth (pitch circle) of the gear 33*e* may be determined to one-third that of gear 33*c*.

The means 34 for moving the gripping means 33 in the sheet transferring direction d2 comprises a moving frame 34*a* rockingly supporting the frame member 33*a* of the gripping means 33 at the shaft al, a belt 34*b* connected to the moving frame 34*a*, pulleys 34*c* between which the belt 34*b* is supported, a motor 34*d* for driving one of the pulleys 34*c*, and means 34*e* for transmitting rotation of the motor 34*d* to the driving pulley 34*c*.

With the rotation of the motor 34*d* transmitted to the moving frame 34*a* through the transmitting means 34*e*, pulleys 34*c* and belt 34*b*, the moving frame is moved in the sheet transferring direction d2.

The tilting means 35 for vertically rocking the gripping means 33 comprises a motor 35*a* fixed on the moving frame 34*a*, a toothed crank wheel 35*b* rotatably supported by the moving frame 34*a* at a shaft a4, a crank arm 35*c* having one end connected to the crank wheel 35*b* via an eccentric pin a5 and the other end connected rotatably to the frame member 33*a* of the gripping means 33, means 35*d* for transmitting rotation of the motor 35*a* to the crank wheel 35*b*.

By operating the motor 35*a* to rotate the crank wheel 35*b* through the transmitting means 35*d*, the crank arm 35*c* connected to the crank wheel 35*b* via the eccentric pin a5 is rockingly moved to rock the frame member 33*a* of the gripping means 33 around the shaft a1, which is connected to the other end of the crank arm 35*c*.

The sheet storage reference surface 16*a* has an opening 16*b* at a sheet releasing position Pr for allowing the rocking motion of the gripping means 33. The gripping means 33 rocks deep downwardly at the sheet releasing position Pr of the opening 16*b*, thus coming close to the second tray 31. Consequently, when the sheaf of sheets is released from the gripping means 33, it can be softly landed on the second tray 31. The upper edge of the sheet storage reference surface 16*a* serves as a guide member 16*c* for allowing the sheaf of sheets released from the gripping means 33 to softly fall to the second tray.

Figure 4:
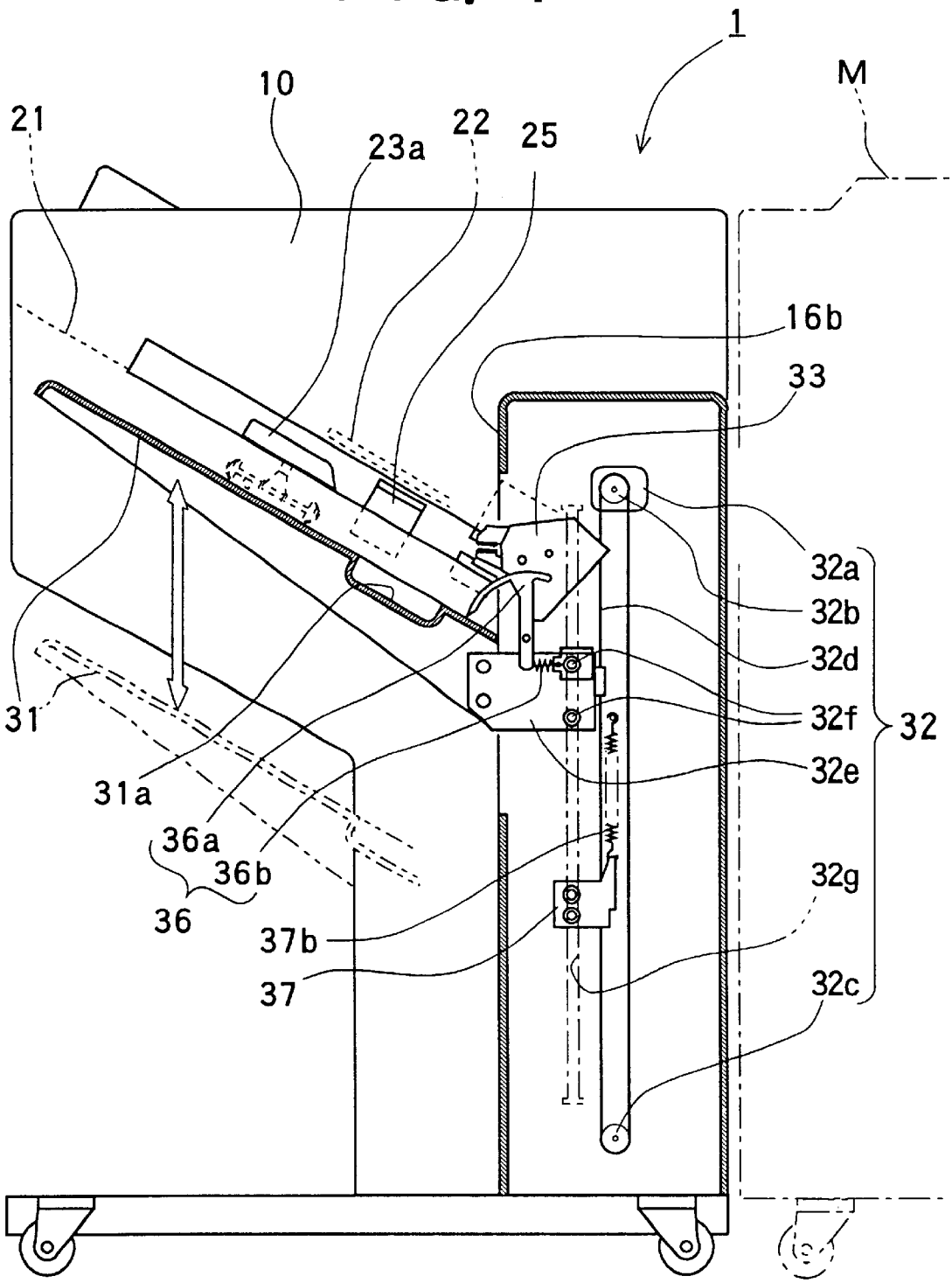
FIG. 4 is a schematic front section taken along the line IV—IV in FIG. 2.

The height detecting means 36 for detecting the height of the bound sheets stacked on the second tray 31 is formed of an arc-shaped finger member 36*a* which is rotatably supported by the device frame at a shaft a6 and constantly energized by a spring 36*b* toward the second tray so as to bring the tip end of the finger member 36*a* in resilient contact with the upper surface of the second tray 31, as shown in FIG. 4. The finger member 36*a* is separable from the second tray 31 against the spring 36*a* by operating an actuator 36*c*.

The finger member 36*a* is urged to come in touch with the second tray 31 to recognize the height of the second tray 31 according to the rotating angle of the finger member 36*a*. Thus, the second tray 31 is controlled by the lifting means 32, so that the upper surface of the second tray 31 or the sheets stacked on the second tray is always positioned at the prescribed level.

Figure 7:
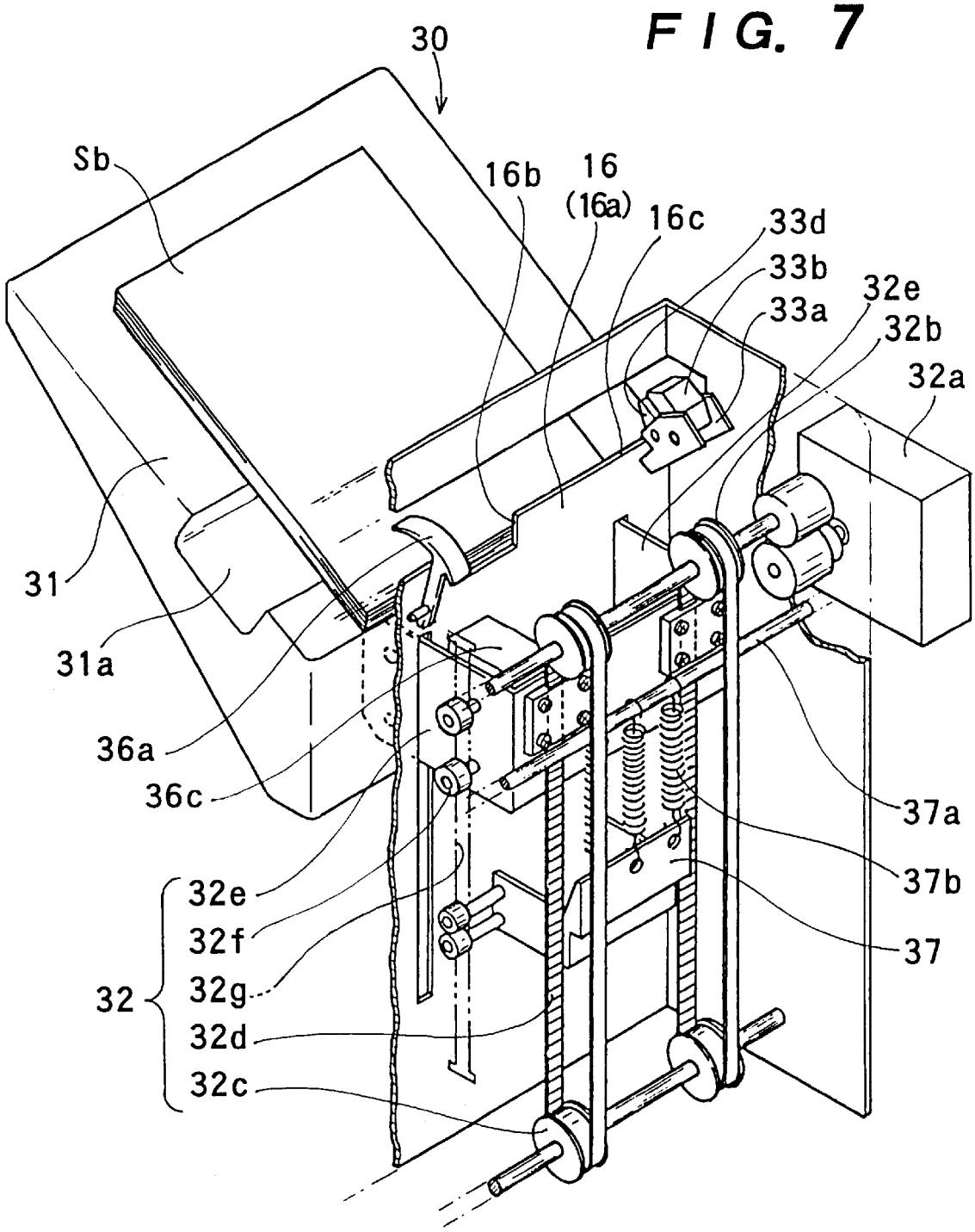
FIG. 7 is a partially cutaway perspective view showing a mechanism for operating a sheet storing section in the device of the invention.

Furthermore, there is disposed an auxiliary lifting frame 37 under the lifting frame 32*e*, which is resiliently hung from a beam 37*a* fixed on the device frame 16 by a spring 37*b*, as shown in FIG. 4 and FIG. 7. When the second tray 31 is loaded down with the sheets to put excessive load on the lifting frame 32*e*, it is sustained by the auxiliary lifting frame 37.

Next, the operation of the sheet post-handling device having the aforementioned structure according to the invention will be described. Specifically in FIG. 9A through FIG. 9F, there are schematically shown moving components generally constituting the sheet post-handling device of the invention, i.e. the waiting tray 22, aligning means 23, shutter 24, transferring means 25, and stapling means 26 in the sheet processing section 20, and the gripping means 33 in the sheet storing section 30.

Figure 9A:
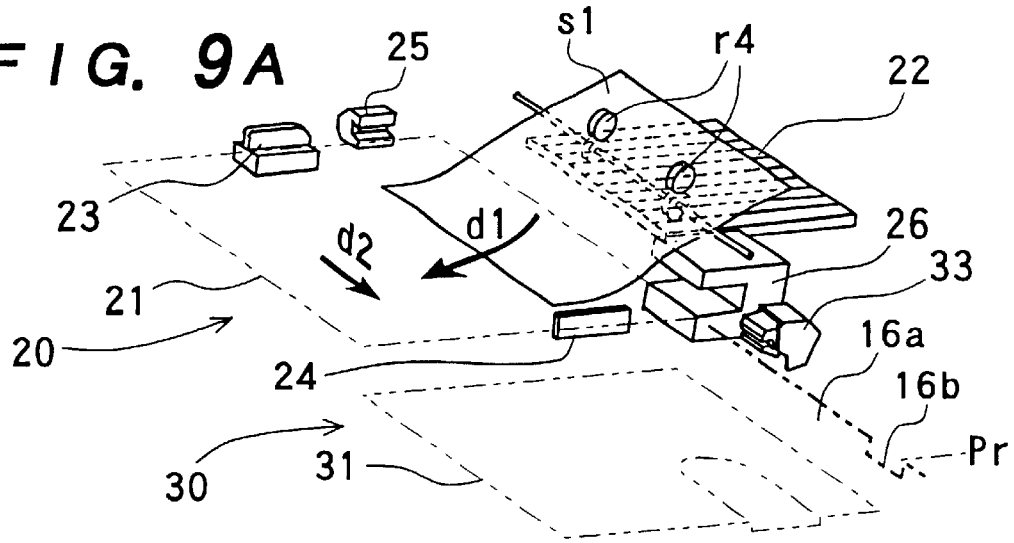
FIG. 9A through FIG. 9F are schematic perspective views explanatory of the operating principle of this invention.
Figure 9B:
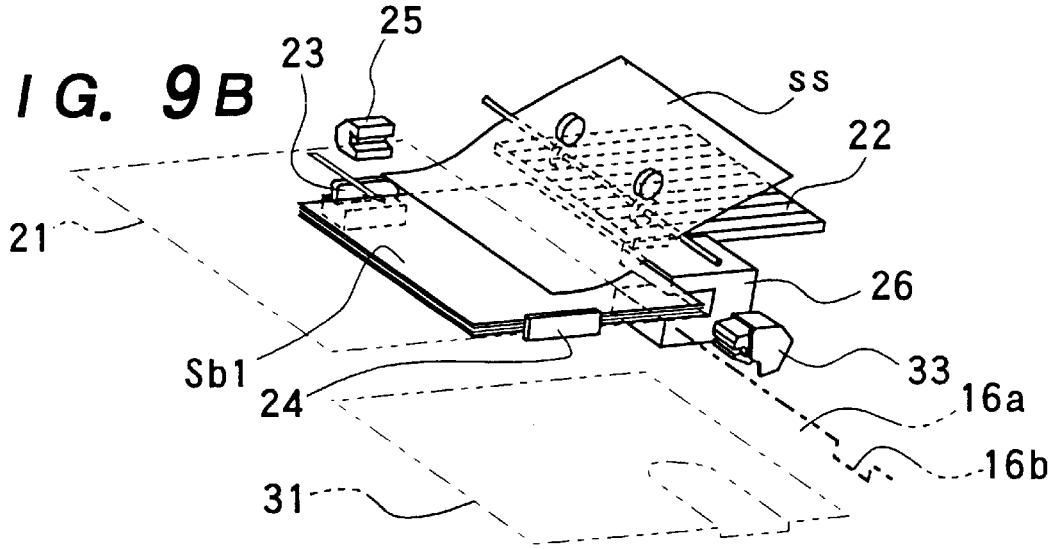
Figure 9C:
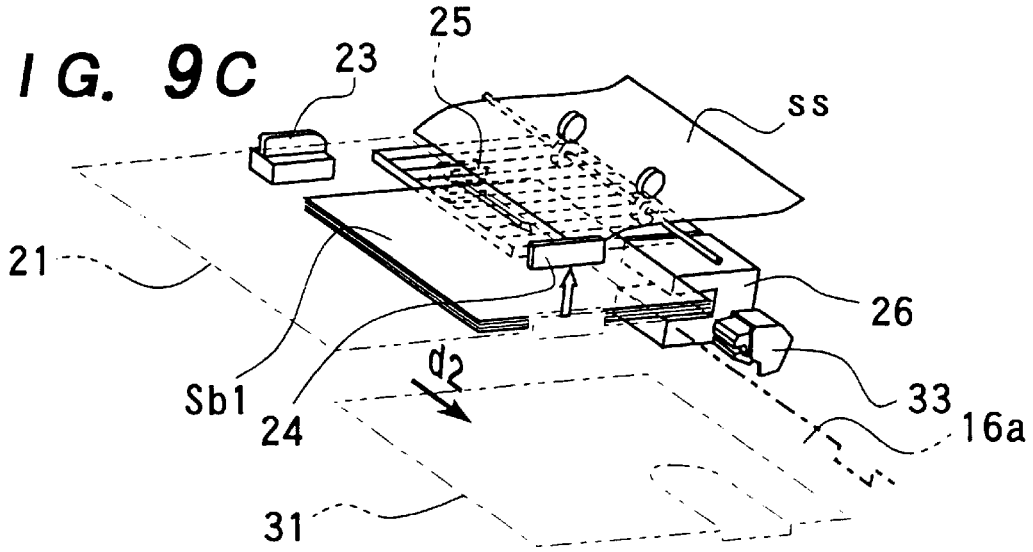
Figure 11A:
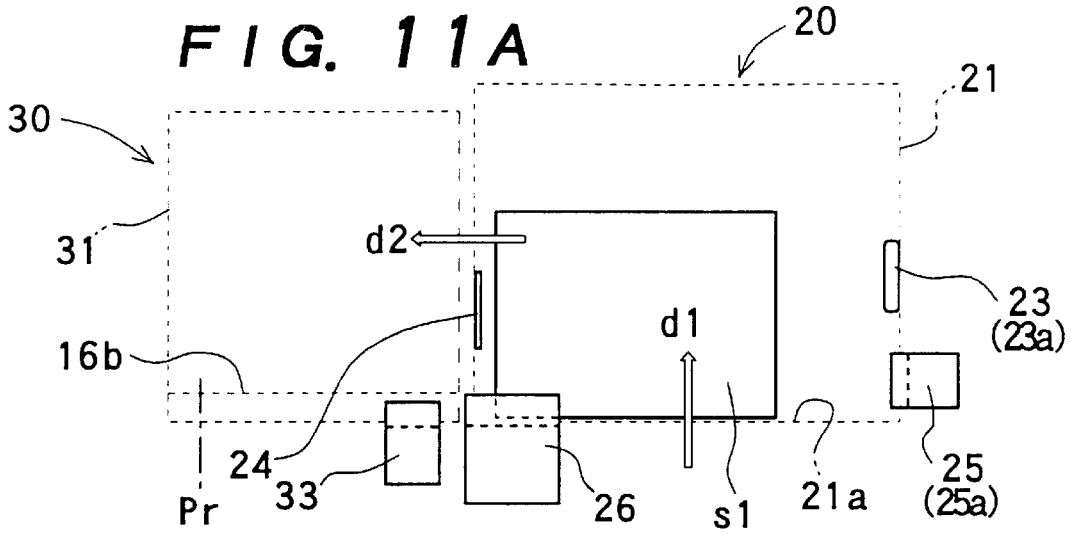
FIG. 11A through FIG. 11F are schematic plan views explanatory of the operating principle of this invention.
Figure 11B:
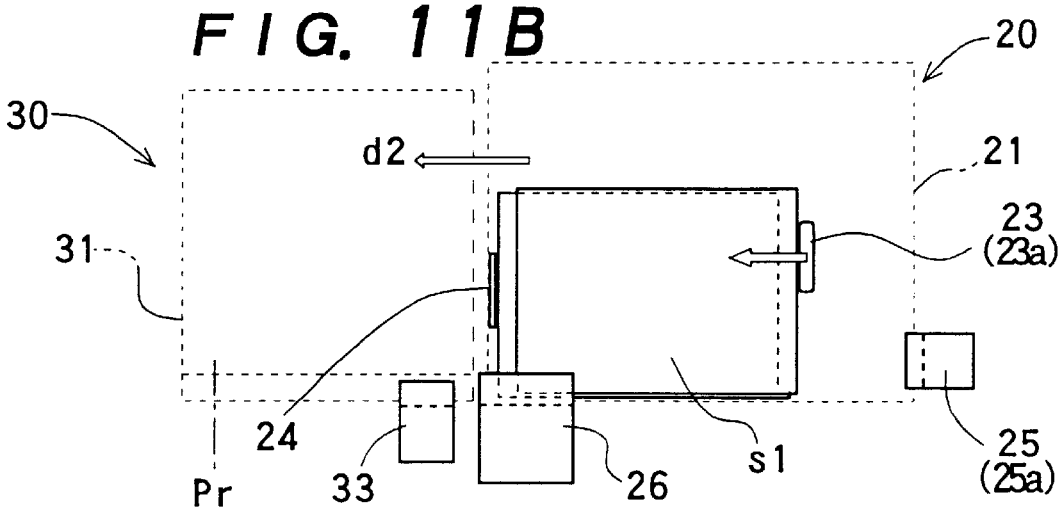

FIG. 9A depicts the initial state in which the aforenoted moving components take their home positions. That is, as shown in FIG. 11A, the aligning means 23 and transferring means 25 in the sheet processing section 20 are positioned at the rear end part of the first tray 21 relative to the sheet transferring direction d2, and the shutter 24 assumes its lower closed position. In the sheet storing section 30, the gripping means 33 is positioned at the rear end of the second tray 31 relative to the sheet transferring direction d2. In this state, a first sheet s1 is sent from the image forming apparatus onto the first tray 21 in the sheet introducing direction d1, and subsequently, succeeding sheets s2, . . . are fed in the same manner. Whenever the sheet is given, the aligning means 23 is operated to move the aligning member 23*a* in the sheet transferring direction d2, consequently to push the sheets s1, s2, . . . against the aligning reference shutter 24 (aligning operation illustrated in FIG. 5, FIG. 9B and FIG. 11B).

Figure 11C:
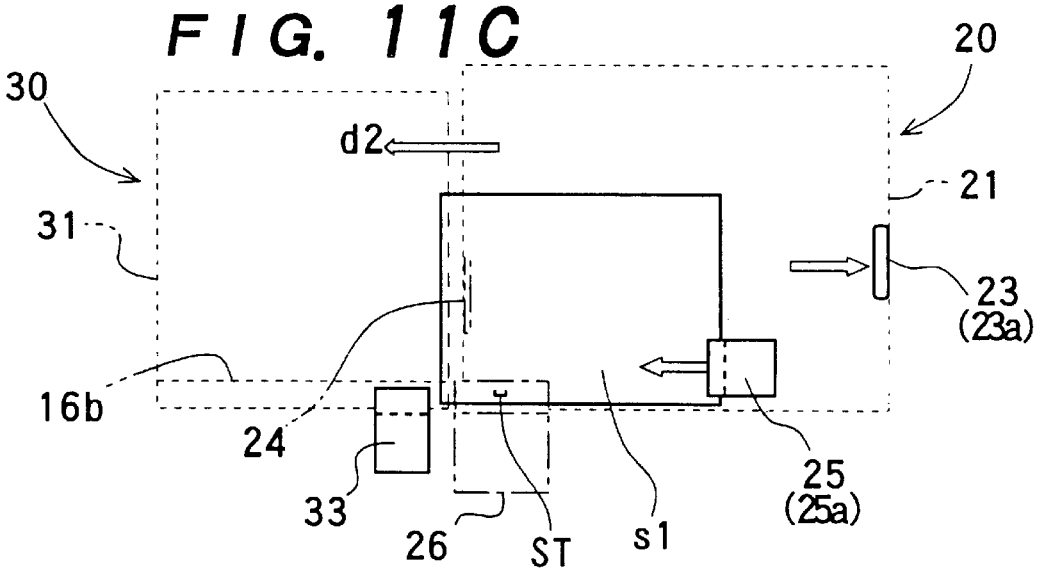

Upon sending all the sheets composing a desired sheaf of sheets Sb1 onto the first tray 21 and aligning the sheets, , the sheet transferring means 25 is operated to move the holding member 25*a* in the sheet transferring direction d2 until the holding member 25*a* collides with the sheets Sb1. When the holding member 25*a* comes into touch with the sheets Sb1, it is operated to grip the tail end part of the sheaf of sheets relative to the sheet transferring direction d2, and then, moved in the sheet transferring direction d2 to transfer the sheets Sb1 (transferring operation shown in FIGS. 9C and 11C).

The sheets are bound with a staple or staples ST during the passage thereof through the stapling means 26. The stapling is effected by operating the stapling means 26 to thrust the staple into the margin part of the sheets (stapling operation shown in FIG. 11C). The sheaf of sheets Sb1 thus stapled is forwarded to the second tray 31. The number of the staples to bind the sheets and the margin position into which the staple is thrust may be arbitrarily determined.

Figure 9D:
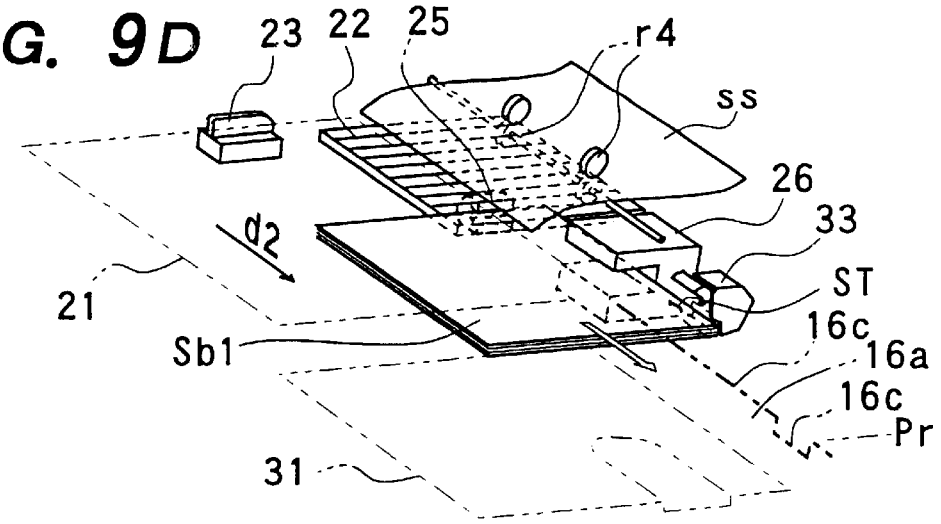
Figure 9E:
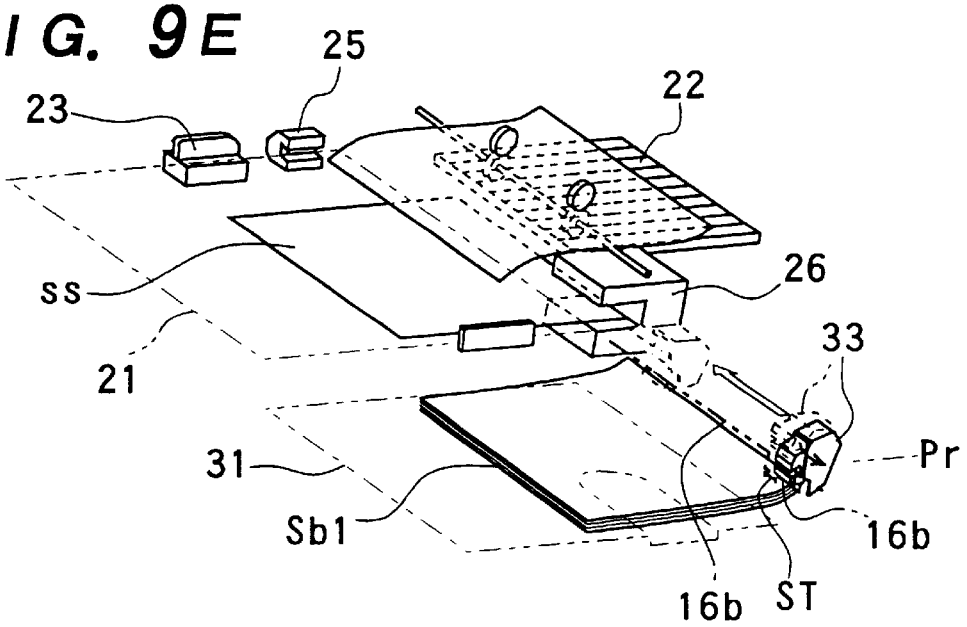
Figure 9F:
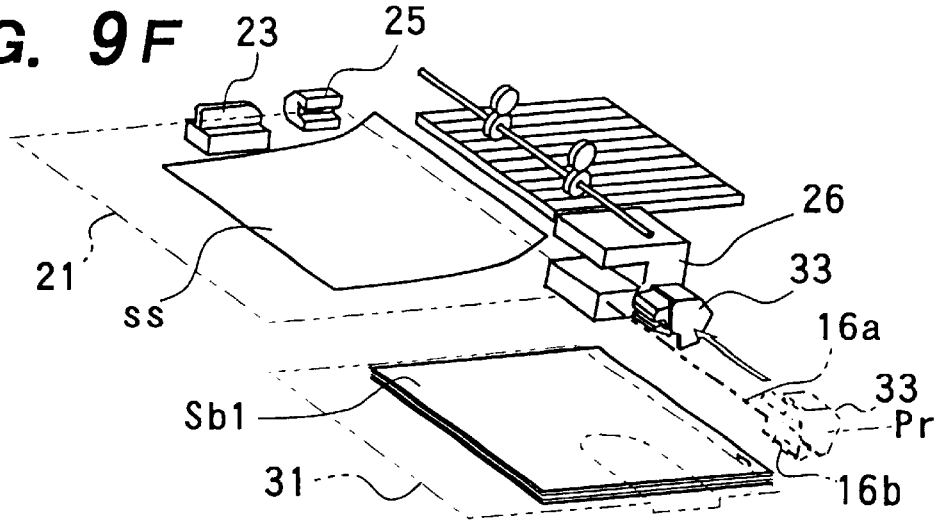
Figure 10A:
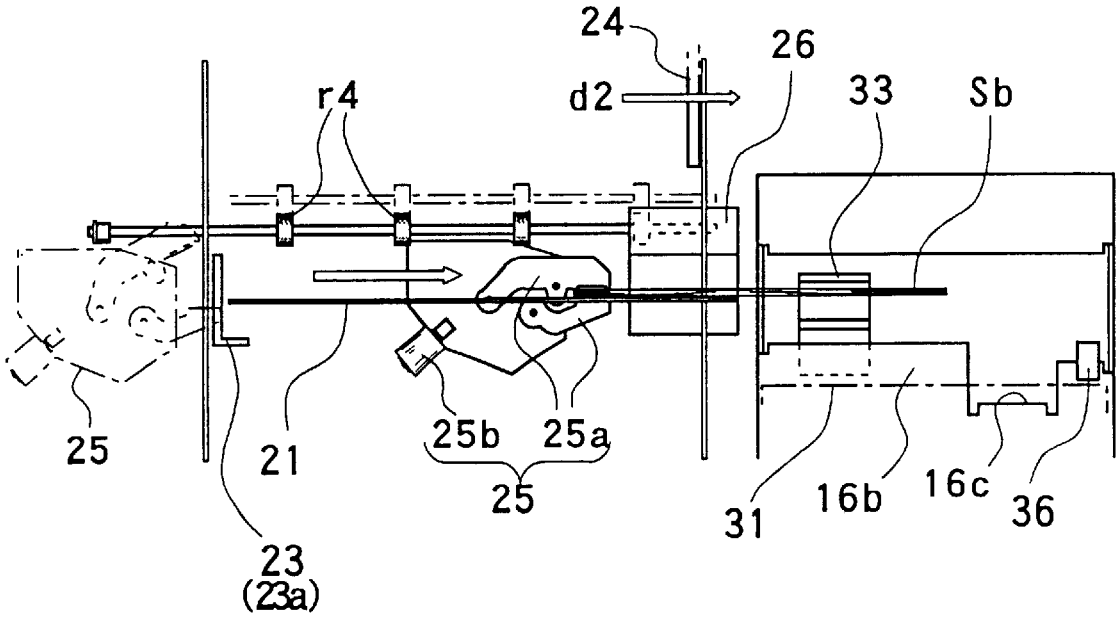
FIG. 10A and FIG. 10B are schematic side views explanatory of the operating principle of this invention.
Figure 11D:
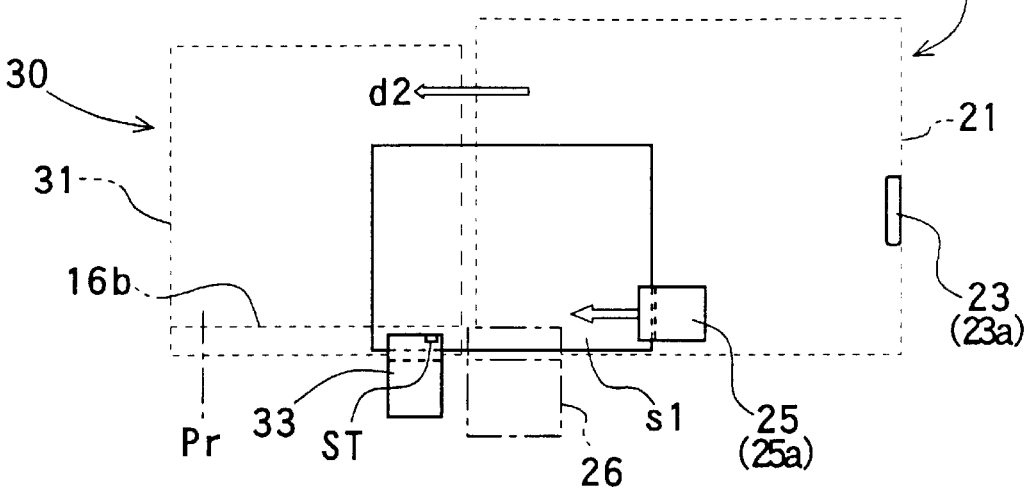

When the sheaf of sheets Sb1 is sent into the sheet storing section 20 by the transferring means 25 and reaches the gripping means 33 as shown in FIGS. 9D, 10A and 11D, the gripping means 33 is operated to grip the sheets Sb1.

In order to steadily deliver the sheets Sb1 moving along the inclined first tray 21 to the gripping means 33, the angle at which the sheets arc gripped by the upper and lower jaws 33*b* and 33*d* of the gripping means 33 is agreed with the inclination of the first tray 21 by operating the tilting means 35.

Upon catching the sheaf of sheets Sb1 by the gripping means 33, it is released from the holding member 25*a* of the transferring means 25, and then, the holding member 25*s* is moved backward to its home position defined at the rear end of the first tray 21.

In a case where the sheets composing the first sheaf Sb1 are completely sent into the first tray, whereupon a sheet for a second sheaf Sb2 is uninterruptedly sent from the image forming apparatus to the first tray 21, the waiting tray 22 is slid out to spread over the first tray 21 so as to receive one or more succeeding sheets ss, as shown in FIG. 9D.

Figure 10B:
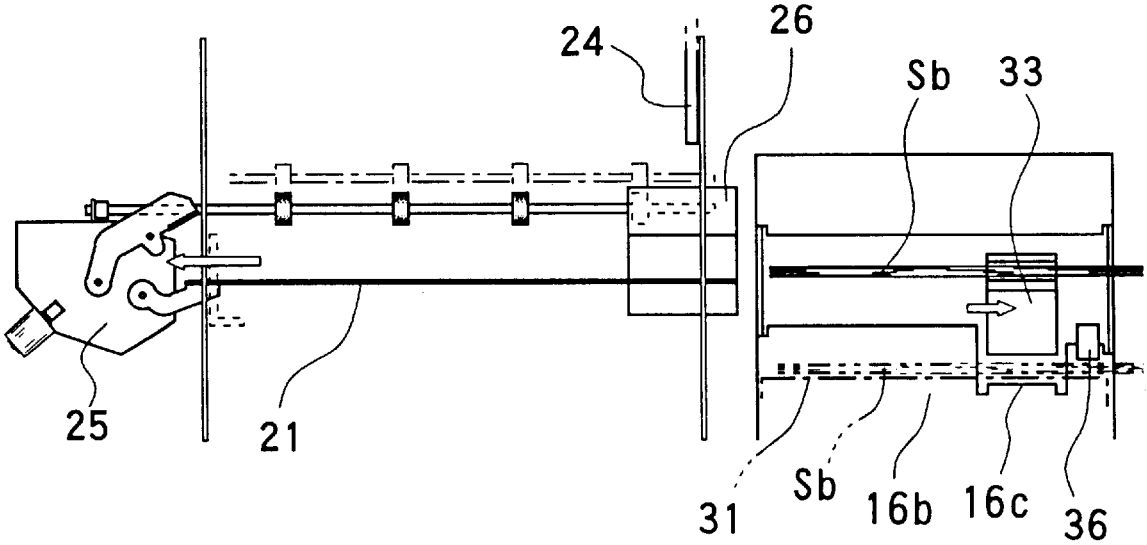
Figure 11E:
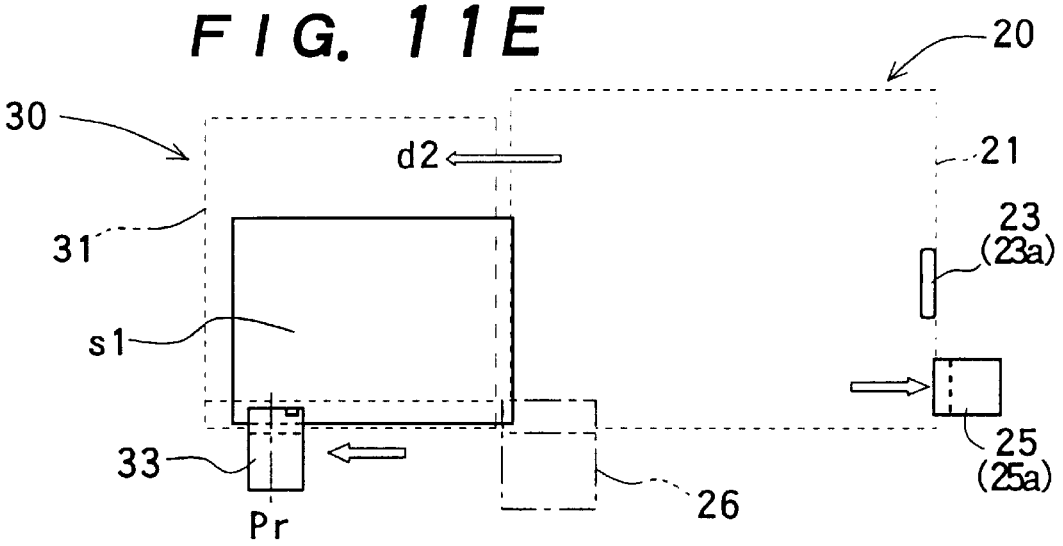

When the gripping means 33, holding the sheaf of sheets Sb1 sent into the sheet storing section 30, arrives at the opening 16*b* formed at the sheet releasing position Pr (FIGS. 9E, 10B and 11E), the gripping means 33 is tilted downward, and then, releases the sheets Sb1.

That is, when the sheaf of sheets Sb1 arrives just over the second tray, the gripping means 33 is operated to open the upper and lower jaws 33*b* and 33*d* of the gripping means 33, but prior to opening the jaws, the gripping means 33 is tilted downward so as to come close to the second tray 31 by operating the tilting means 35, as shown in FIG. 8B.

In the state of opening the upper and lower jaws 33*b* and 33*d* of the gripping means 33 coming close to the second tray 31, the lower jaw 33*d* largely leans downward as indicated by the imaginary line in FIG. 8B, thus enabling the sheets Sb1 to be securely released from the gripping means and softly fall to the second tray.

Figure 11F:
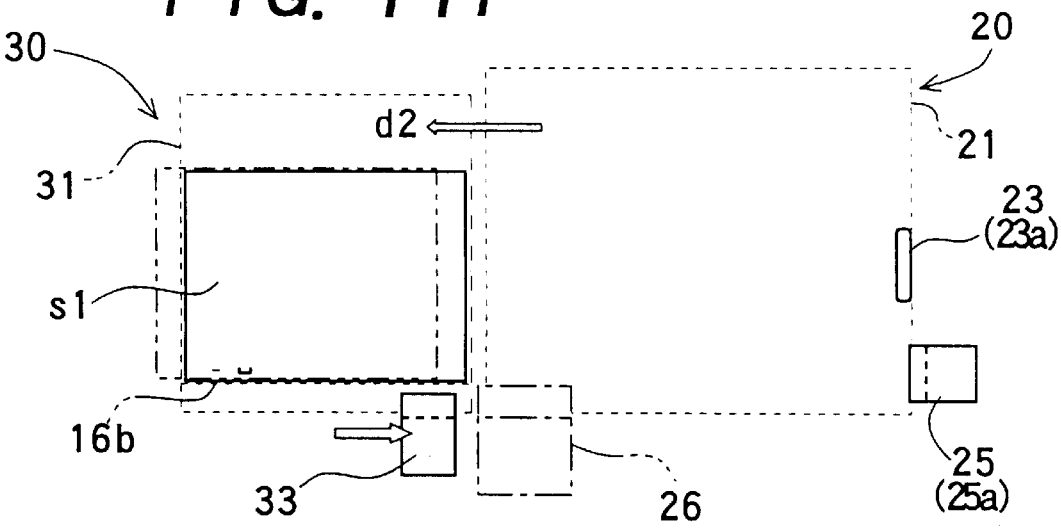

The sheaf of sheets can be successfully stacked on the second tray 31. At this time, the sheaf of sheets slides down along the inclined second tray in the direction opposite to the sheet introducing direction d1, consequently to true up the lower-side edges of the sheets with the sheet storage reference surface 16*a* is defined in the sheet storing section 30, as shown in FIG. 11F.

Thereafter, the gripping means 33 is moved backward to its home position defined at the rear end part of the second tray 31 relative to the sheet transferring direction d2. In the manner described above, the desired process of transferring and storing the sheets successively fed from the image forming apparatus is completed.

In a case of carrying on consecutive sheet handling for the following sheaves of sheets, the the same procedures as specified above may be repeated, but when the succeeding sheaves of sheets are sent consecutively from the sheet processing section 20 to the sheet storing section 30, it is desirable to displace alternately the sheaves of sheets slightly. For example, the following sheaf of sheets Sb2 is put on the preceding sheaf of sheets Sb1, so that the stapled portion St1 of the preceding sheets Sb1 is slightly displaced from the stapled portion St2 of the following sheets Sb2 in the sheet transferring direction d2, so as not to put the stapled portions on top of each other. The operation of displacing the sheaves of sheets succeedingly sent from the sheet processing section to the sheet storing section is fulfilled by varying the position at which the sheaf of sheets is released from the gripping means 33. According to this measure, the bulk of the sheaves of sheets accumulated on the second tray can be reduced.

The sequential processes of taking in, aligning, moving and binding given sheets in the sheet processing section, and processes of transferring the sheets from the sheet processing section to the sheet storing section, moving and releasing the sheets in the sheet storing section are repeatedly carried out as long as succeeding sheets are fed consecutively from the image forming apparatus.

As is explained above, according to the sheet post-handling device of the invention, since one or more sheets fed onto the first tray are held by the holding member, transferred from the holding member in the sheet processing section to the gripping means in the sheet storing section, and released from being gripped at the sheet releasing position, the sheets can be stably transferred with high efficiency without imposing a burden on the sheets even when they are handled at a high speed, and softly landed on the second tray.

As many apparently widely different embodiments of this invention may be made without departing from the spirit and scope thereof, it is to be understood that the invention is not limited to the specific embodiments thereof except as defined in the appended claims.

What is claimed is:

1. A sheet post-handling device comprising a first tray for stacking one or more sheets thereon, means for transferring said one or more sheets stacked on said first tray, a second tray for stacking the sheets sent by said transferring means, means for gripping the sheets transferred from said first tray to said second tray, and means for moving said gripping means along said second tray, said transferring means including a holding member for holding the sheets stacked on said first tray, and means for moving said holding member along said first tray.

2. A sheet post-handling device as claimed in claim 1, further comprising means for tilting vertically said gripping means.

3. A sheet post-handling device as claimed in claim 1, further comprising tilting means for moving said gripping means downward after moving forward said gripping means.

4. A sheet post-handling device as claimed in claim 3, wherein said gripping means includes upper and lower jaws rotatable up and down to open and close, said lower jaw being openable more widely than said upper jaw.

5. A sheet post-handling device as claimed in claim 3, wherein said gripping means is rockingly movable downward to release said one or more sheets from said gripping means.

6. A sheet post-handling device as claimed in claim 1, wherein said second tray is provided at its rear side relative to a direction in which a sheet is introduced onto said first tray with a sheet storage reference surface, and said gripping means is positioned opposite to said section tray across said sheet storage reference surface.

7. A sheet post-handling device as claimed in claim 6, wherein said sheet storage reference surface has an upper edge for guiding the sheets released from said gripping means.

8. A sheet post-handling device as claimed in claim 6, wherein said sheet storage reference surface has an opening for allowing said gripping means to tilt downward.

9. A sheet post-handling device as claimed in claim 8, wherein said gripping means is movable downward through said opening formed in said sheet storage reference surface to release said one or more sheets gripped by said gripping means to said second tray.

10. A sheet post-handling device as claimed in claim 1, further comprising means for stapling the sheets stacked on said first tray.

11. A sheet post-handling device as claimed in claim 1, wherein a direction in which a sheet is introduced into said first tray is perpendicular to a direction in which said one or more sheets stacked on said first tray are transferred from said first tray to said second tray.

12. A sheet post-handling device as claimed in claim 1, further comprising lifting means for moving vertically said second tray in accordance with the sheets stacked on said second tray.

* * * * *